US007397731B2

(12) United States Patent
Scurlock et al.

(10) Patent No.: US 7,397,731 B2
(45) Date of Patent: Jul. 8, 2008

(54) PERPETUAL DAY REMINDER CALENDAR

(75) Inventors: James Allen Scurlock, 6413 Beverly Dr., Parma Heights, OH (US) 44130; John Lorne Scurlock, Parma Heights, OH (US)

(73) Assignee: James Allen Scurlock, Parma Heights, OH (US)

( * ) Notice: Subject to any disclaimer, the term of this patent is extended or adjusted under 35 U.S.C. 154(b) by 3 days.

(21) Appl. No.: 11/500,007

(22) Filed: Aug. 7, 2006

(65) Prior Publication Data

US 2008/0037373 A1 Feb. 14, 2008

(51) Int. Cl.
*G04B 19/24* (2006.01)
*G09D 3/00* (2006.01)

(52) U.S. Cl. ..... 368/28; 40/107; 40/122

(58) Field of Classification Search ..... 368/28; 40/107, 119–122; 283/2
See application file for complete search history.

(56) References Cited

U.S. PATENT DOCUMENTS

| | | | | | |
|---|---|---|---|---|---|
| 959,479 | A | * | 5/1910 | Doolittle | 283/4 |
| 1,501,803 | A | | 7/1924 | Orth | |
| 1,668,818 | A | | 5/1928 | Neale, Jr. | |
| 1,681,235 | A | | 8/1928 | Hiering | |
| 2,048,415 | A | | 7/1936 | Trollen | |
| 2,096,248 | A | | 10/1937 | Huston | |
| 3,419,011 | A | | 12/1968 | Norris | |
| 3,564,741 | A | | 2/1971 | Kahre | |
| 3,670,436 | A | * | 6/1972 | Weissman | 40/107 |
| 3,853,741 | A | | 12/1974 | Klupt | |
| D245,422 | S | | 8/1977 | Vanderhyden, Jr. | |
| D297,244 | S | | 8/1988 | Kennedy | |
| 4,934,076 | A | * | 6/1990 | Fowler | 40/107 |
| 6,467,205 | B1 | | 10/2002 | Flagg | |
| D498,789 | S | * | 11/2004 | Lawson | D19/25 |

FOREIGN PATENT DOCUMENTS

| | | |
|---|---|---|
| DE | 421292 | 2/1925 |
| GB | 831572 | 7/1957 |
| WO | WO84/03384 | 8/1984 |

* cited by examiner

*Primary Examiner*—Edwin A. Leon
*Assistant Examiner*—Thanh S Phan

(57) ABSTRACT

A perpetual day reminder calendar consisting of display stand, date indicating cubes, day indicating plates and month indicating plates uniquely styled for ease of operation and clarity of information. The displaying of the current day is accomplished by the use of indica placed on both sides of day indicating plates, the current date is accomplished by the use of indica placed on the faces of date indicating cubes, and the current month of the year is accomplished by the use of indica placed on both sides of month indicating plates. The calendar's functional components are presented and held securely by use of a display stand. The display stand also offers at least one surface for information or advertising.

2 Claims, 8 Drawing Sheets

PERPETUAL DAY REMINDER CALENDAR

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates to calendars; specifically, day reminder calendars, perpetual and multi year calendars, calendar design and calendar construction.

2. Prior Art

Previously; many day reminder calendars were made with tearaway paper sheets arranged in a pad. Dailey a page is torn off exposing the next calendar date. For example: U.S. Pat. No. 3,419,011 (1968) to Norris. Each day the calendar diminishes piece by piece creating trash which is problematic and wasteful. Frequently two or more pages may be torn off accidently. These annual calendars must be purchased at the beginning of the year to realize their maximum value.

The solution to these limitations is the perpetual day reminder calendar. These ever renewable non obsoletable calendars come in many different creations. For example: U.S. Pat. No. 1,501,803 (1924) to Orth; U.S. Pat. No. 1,681,235 (1928) to Hiering; U.S. Pat. No. 2,096,248 (1937) to Huston; U.S. Pat. No. 2,048,415 (1936) to Trollen; U.S. Pat. No. Des. 297,244 (1988) to Kennedy; U.S. Pat. No. 3,564,741 (1971) to Kahre Et Al and U.S. Pat. No. 3,670,436 (1972) to Weissman. Each of these prior art calendars contains some or all of the following deficiencies:

a) do not have good proportion between elements;
b) a reliance on abbreviations;
c) clumsy to manipulate;
d) difficult to read;
e) they don't always shield unwanted information;
f) poor styling.

BACKGROUND OF THE INVENTION—ADVANTAGES

All of the embodiments of this invention have the advantage of being perpetual calendars.

Perpetual Calendars:

a) can be sold any time of the year;
b) do not generate daily trash;
c) never go obsolete;
d) economical to use;
e) good teaching aids.

Accordingly, one or more embodiments of the present invention may have some or all of the following advantages:

a) improved styling;
b) improved access to functional elements;
c) easier to read and understand;
d) rapid assembly and disassembly;
e) can be manufactured in many colors;
f) can be manufactured in a variety of materials;

g) no extraneous calendar information is exposed;
h) adaptable to many fonts and languages;
i) enjoyable to operate.

This invention provides a superior perpetual calendar construction and an improved synergistic relationship of the calendar's elements. Further advantages will become apparent from a consideration of the drawings and ensuing descriptions.

SUMMARY

In accordance with the present invention a perpetual day reminder calendar comprises, day indicating plates, month indicating plates, date indicating cubes and a display stand. These elements are used to indicate the name of the day of the week, the numerical value of the day of the month and the name of the month of the year.

DRAWINGS—FIGURES

Figure 1:
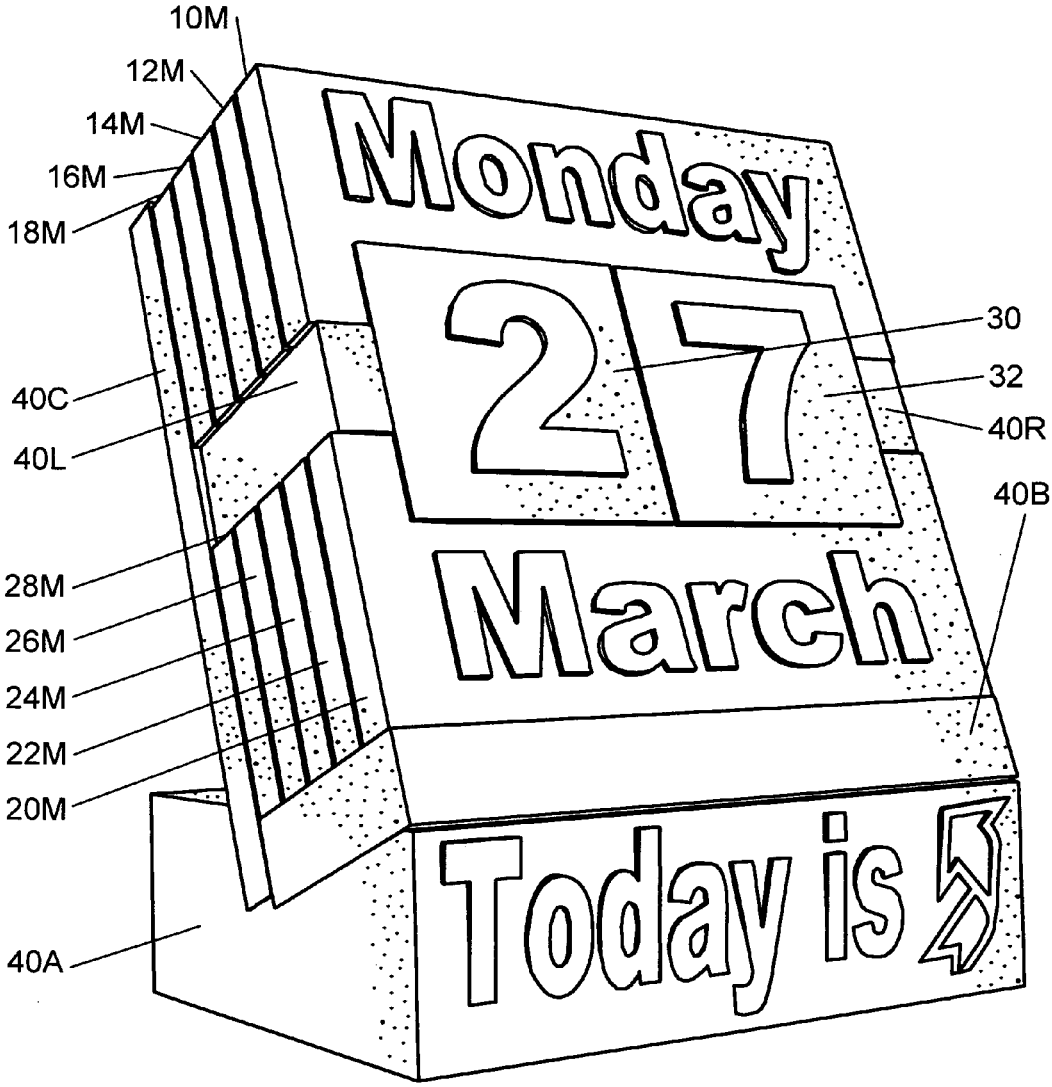
Figure 2:
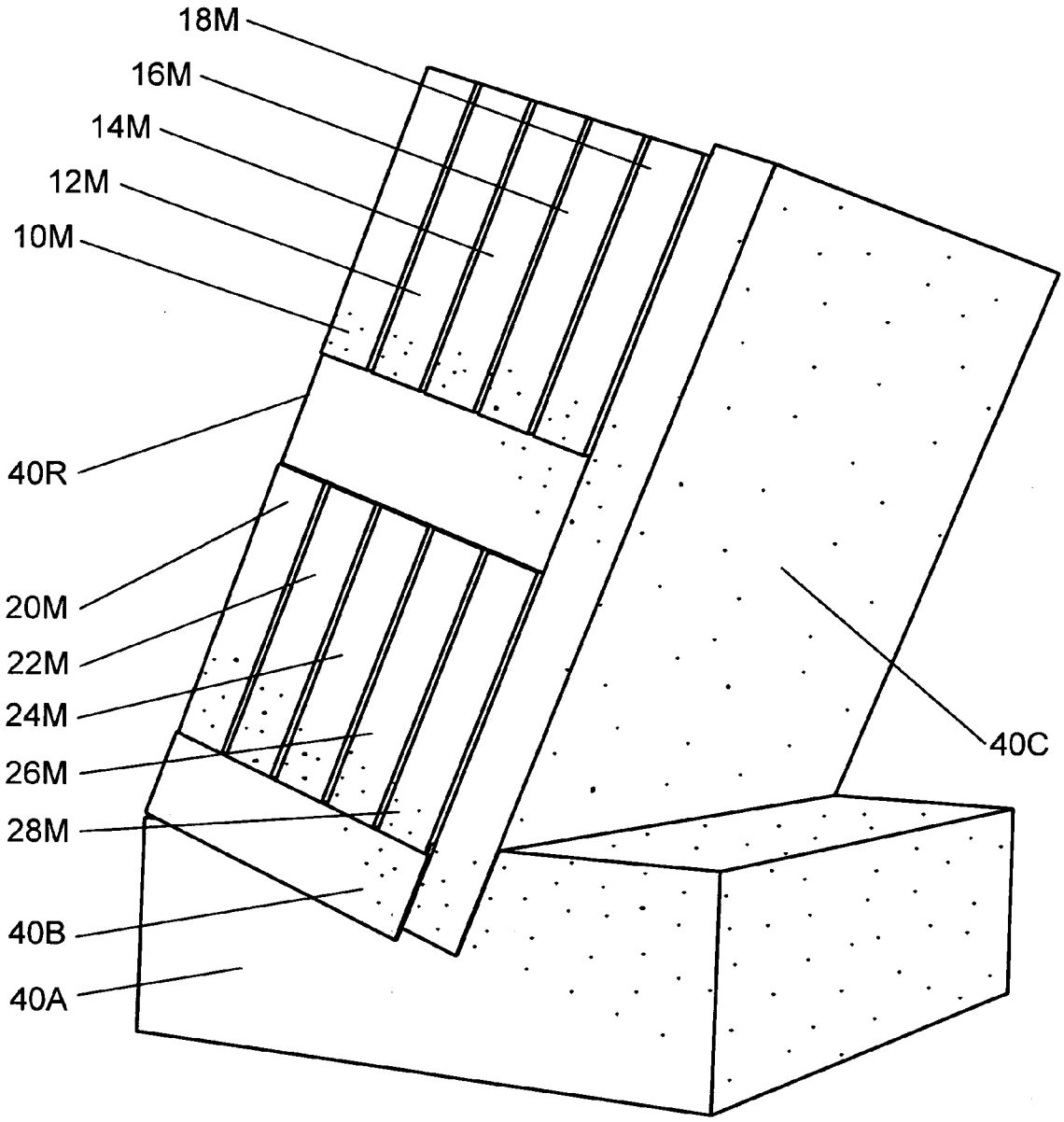
Figure 3:
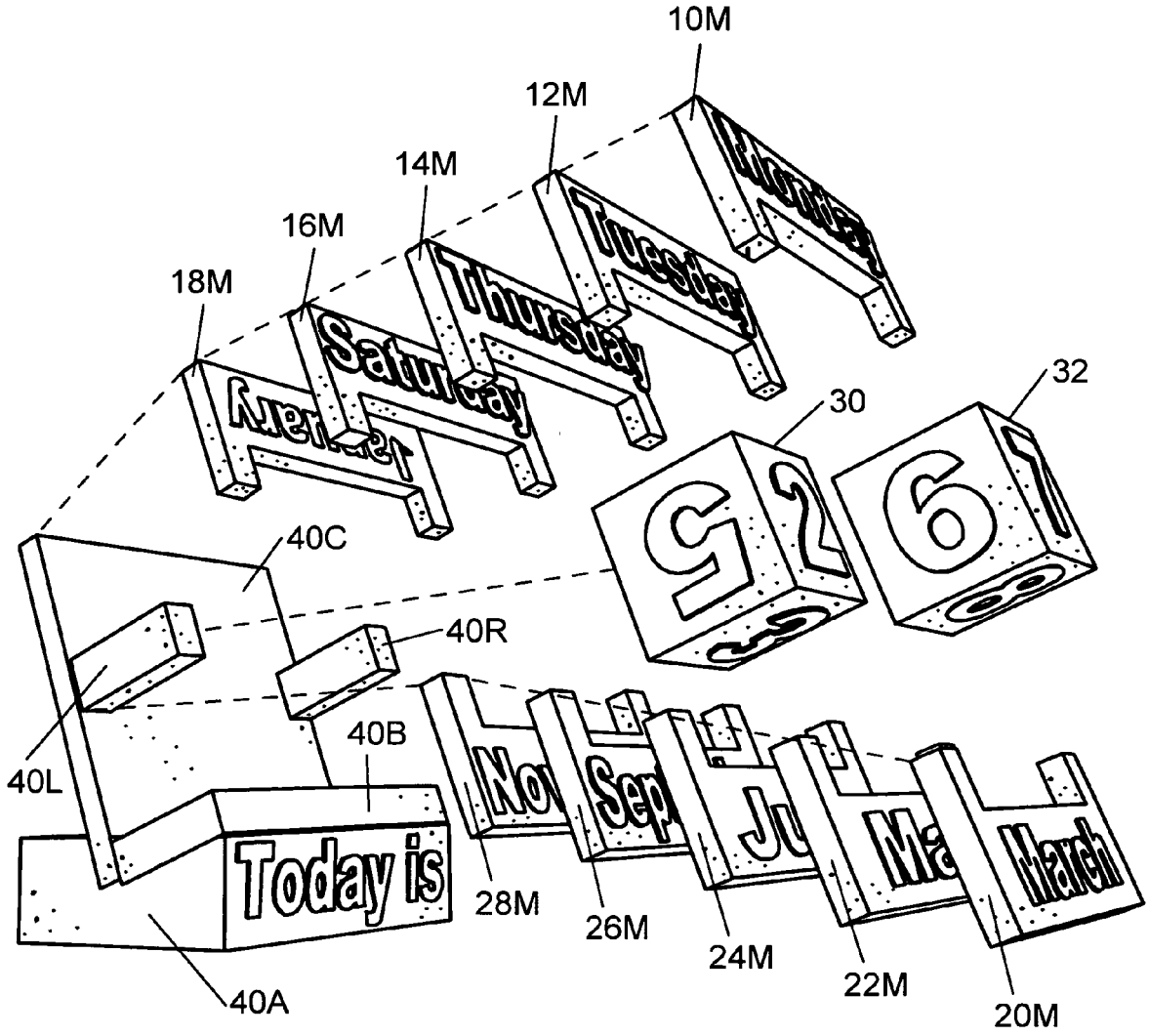
Figure 4:
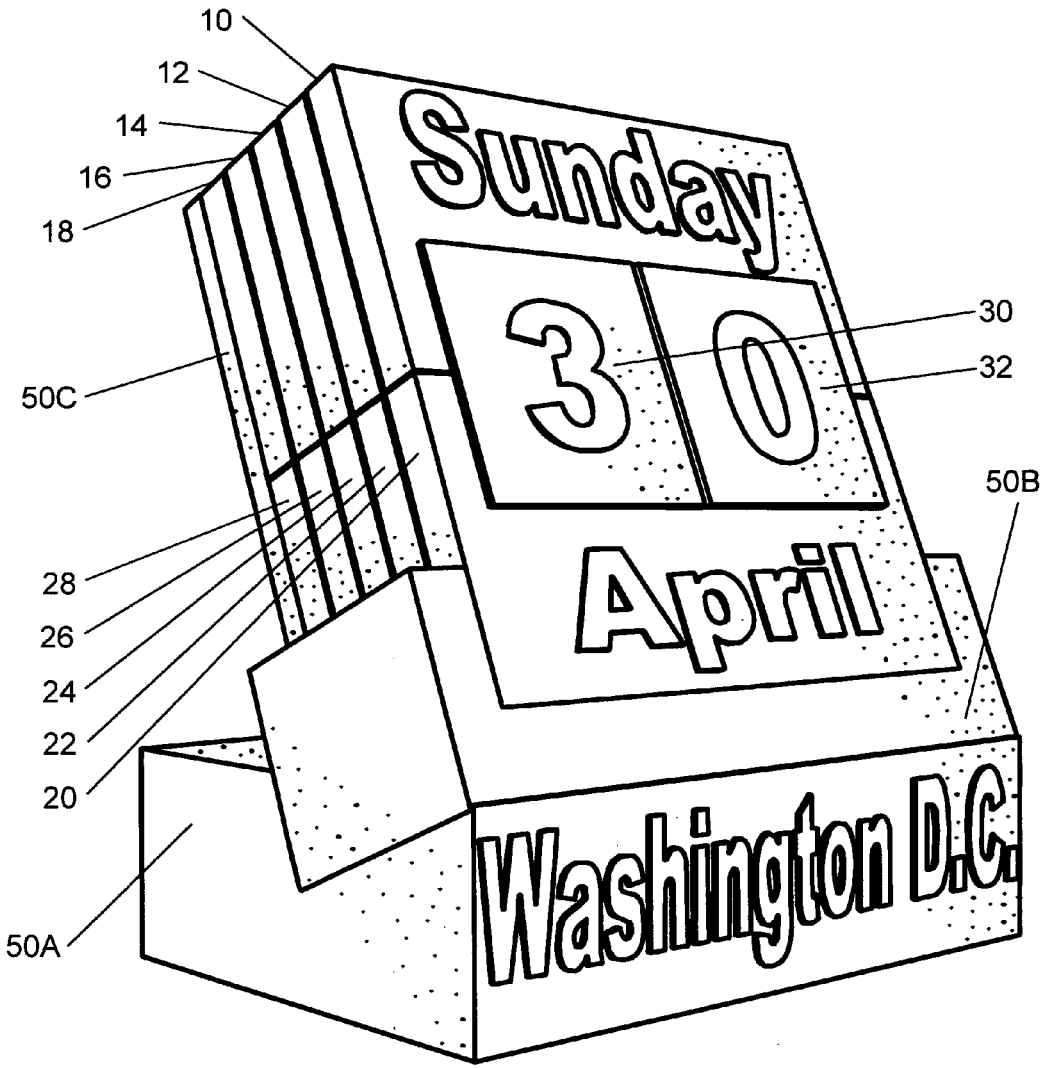
Figure 5:
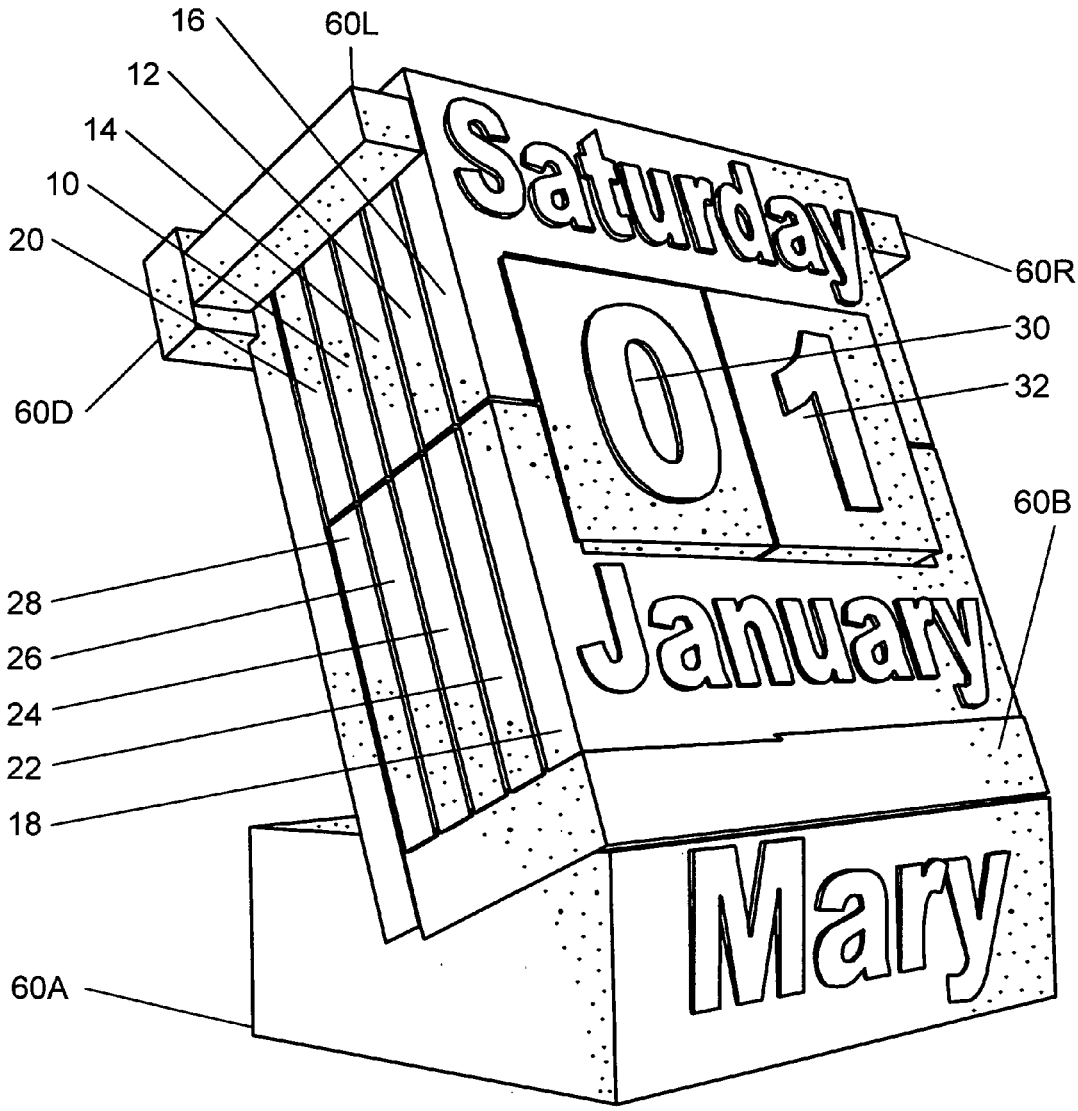
Figure 6:
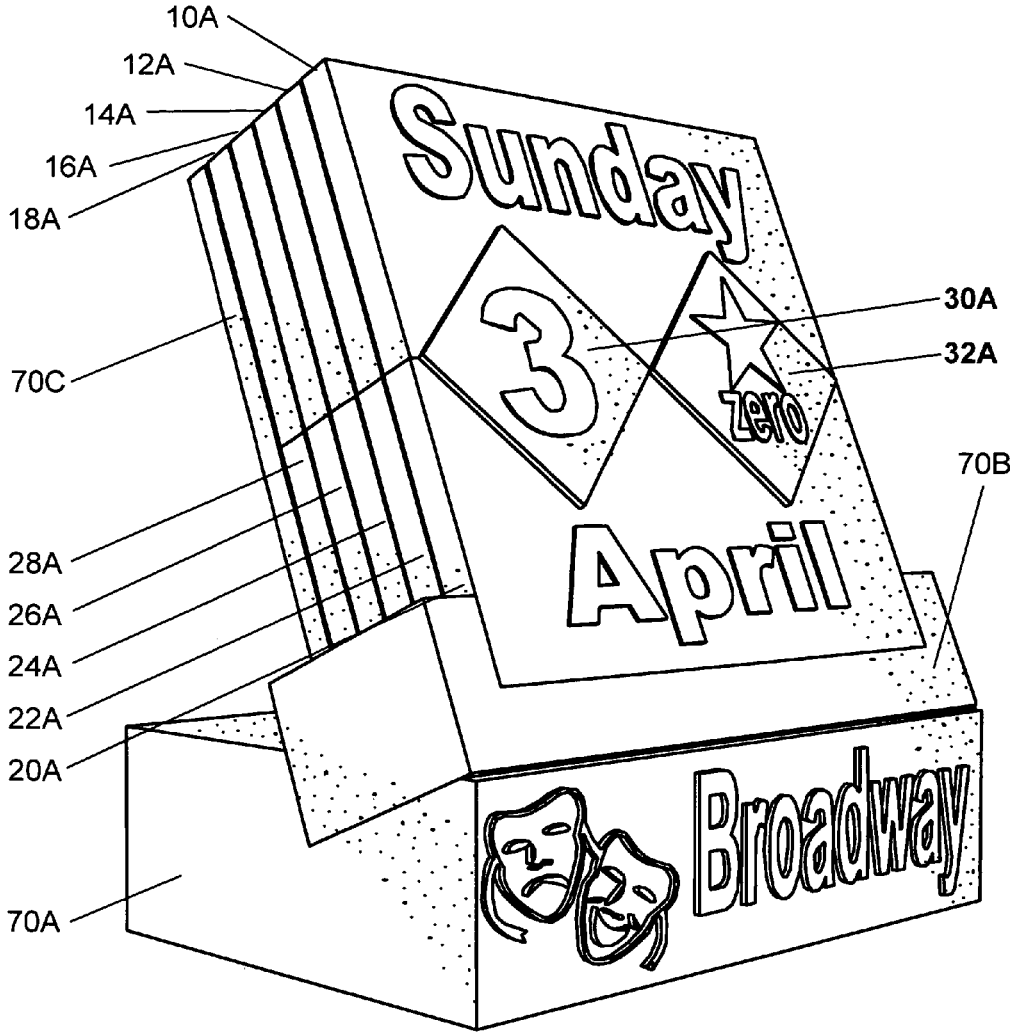
Figure 7:
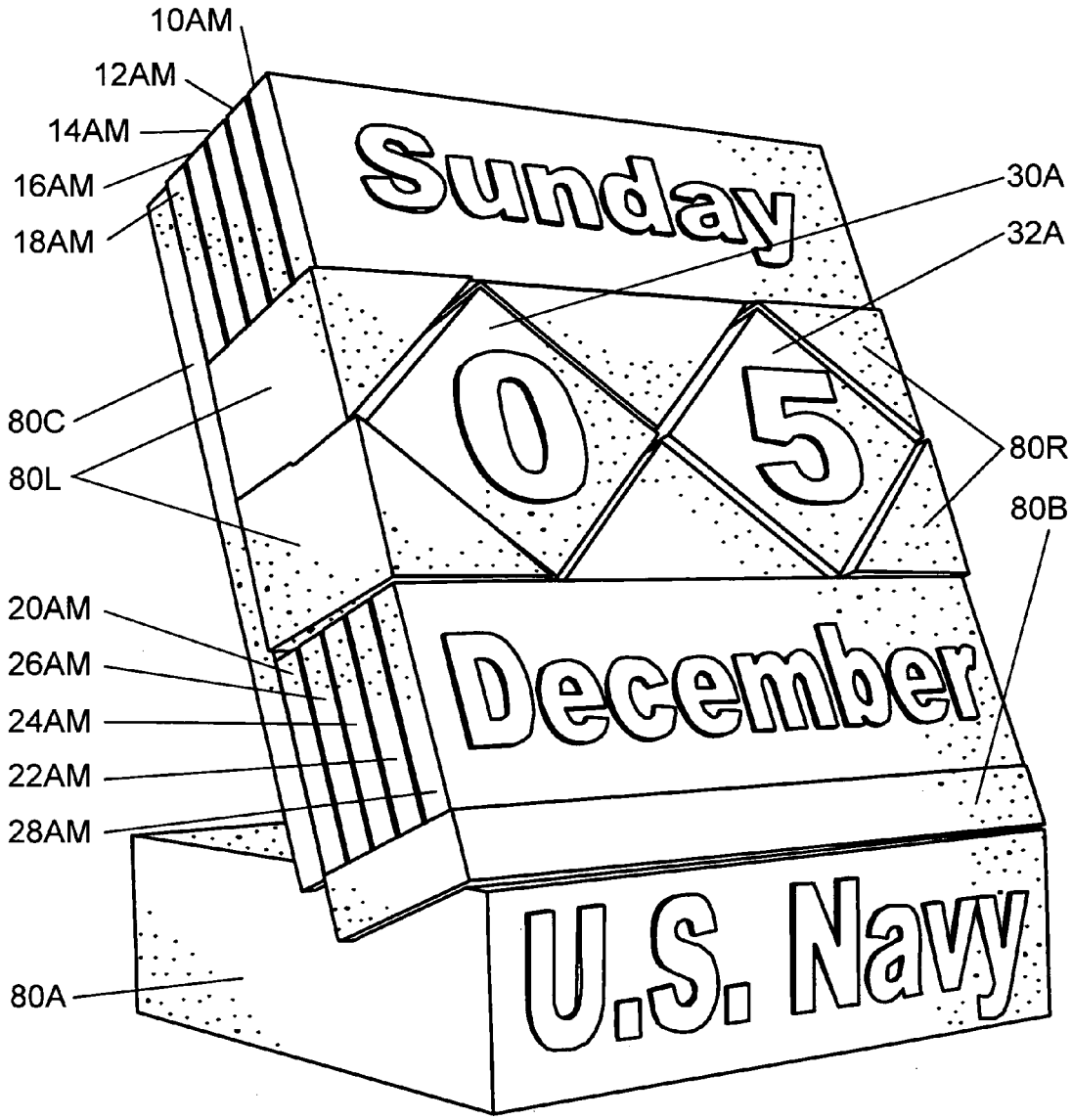
Figure 8:
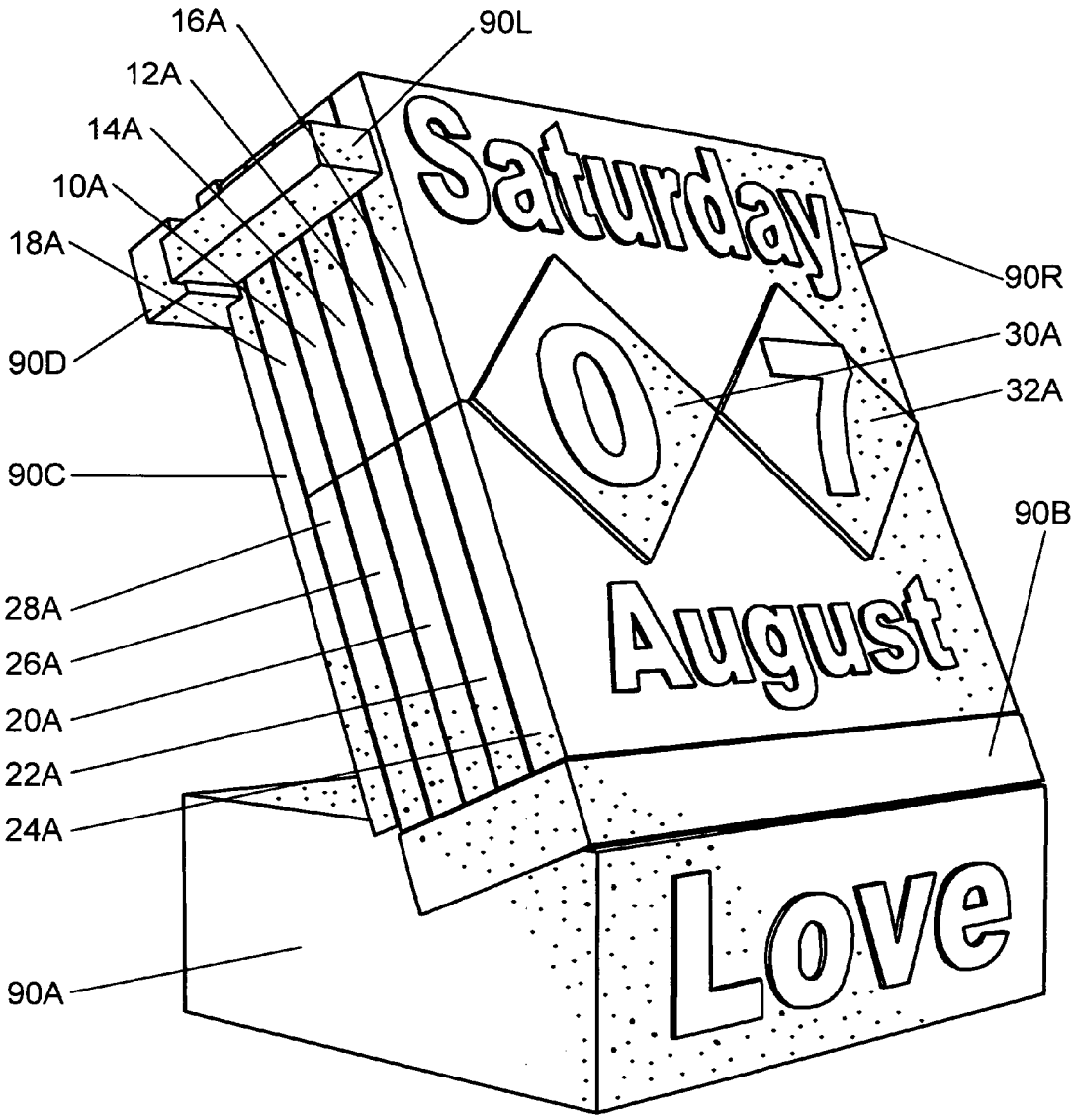

FIG. 1—front perspective view of center holding display stand and calendar stack FIG. 2—back perspective view of center holding display stand and calendar stack FIG. 3—perspective view of center holding display stand with explosion of calendar stack FIG. 4—front perspective view of bottom holding display stand and calendar stack FIG. 5—front perspective view of top holding display stand and calendar stack FIG. 6—front perspective view of bottom holding display stand and calendar stack with rotated date cubes FIG. 7—front perspective view of center holding display stand and calendar stack with rotated date cubes FIG. 8—front perspective view of top holding display stand and calendar stack with rotated date cubes

DRAWINGS—REFERENCE NUMERALS

In the reference numerals, closely related elements or components of some parts have the same number but different alphabetic suffixes.

Reference numerals FIGS. 1, 2, 3, 4, and 5:

10M—Sunday/Monday day indicating plate—modified shape

12M—Tuesday/Wednesday day indicating plate—modified shape

14M—Thursday/Friday day indicating plate—modified shape

16M—Saturday/Blank day indicating plate—modified shape

18M—January/February month indicating plate—modified shape

20M—March/April month indicating plate—modified shape

22M—May/June month indicating plate—modified shape

24M—July/August month indicating plate—modified shape

26M—September/October month indicating plate—modified shape

28M—November/December month indicating plate—modified shape

10—Sunday/Monday day indicating plate

12—Tuesday/Wednesday day indicating plate

14—Thursday/Friday day indicating plate

16—Saturday/Blank day indicating plate

18—January/February month indicating plate

20—March/April month indicating plate
22—May/June month indicating plate
24—July/August month indicating plate
26—September/October month indicating plate
28—November/December month indicating plate
30—0,1,2,3,4,5 date indicating cube
32—0,1,2,6,7,8 date indicating cube
40A—Base of center holding display stand
40B—Bottom of center holding display stand
40C—Back of center holding display stand
40L—Left Side Guide of center holding display stand
40R—Right Side Guide of center holding display stand
50A—Base of bottom holding display stand
50B—Bottom of bottom holding display stand
50C—Back of bottom holding display stand
60A—Base of top holding display stand
60B—Bottom of top holding display stand
60C—Back of top holding display stand
60D—Top holder of top holding display stand
60L—Top holder left side guide of top holding display stand
60R—Top holder right side guide of top holding display stand Reference numerals FIGS. 6, 7 and 8:

10AM—Sunday/Monday day indicating plate—modified shape
12AM—Tuesday/Wednesday day indicating plate—modified shape
14AM—Thursday/Friday day indicating plate—modified shape
16AM—Saturday/Blank day indicating plate—modified shape
18AM—January/February month indicating plate—modified shape
20AM—March/April month indicating plate—modified shape
22AM—May/June month indicating plate—modified shape
24AM—July/August month indicating plate—modified shape
26AM—September/October month indicating plate—modified shape
28AM—November/December month indicating plate—modified shape
10A—Sunday/Monday day indicating plate
12A—Tuesday/Wednesday day indicating plate
14A—Thursday/Friday day indicating plate
16A—Saturday/Blank day indicating plate
18A—January/February month indicating plate
20A—March/April month indicating plate
22A—May/June month indicating plate
24A—July/August month indicating plate
26A—September/October month indicating plate
28A—November/December month indicating plate
30A—0,1,2,3,4,5 rotated date indicating cube
32A—0,1,2,6,7,8 rotated date indicating cube
70A—Base of bottom holding display stand
70B—Bottom of bottom holding display stand
70C—Back of bottom holding display stand
80A—Base of center holding display stand
80B—Bottom of center holding display stand
80C—Back of center holding display stand
80L—Left Side Guide of center holding display stand
80R—Right Side Guide of center holding display stand
90A—Base of top holding display stand
90B—Bottom of top holding display stand
90C—Back of top holding display stand
90*d*—Top holder of top holding display stand
90L—Top holder left side guide of top holding display stand
90R—Top holder right side guide of top holding display stand

DETAILED DESCRIPTIONS

DESCRIPTION—FIGS. 1, 2, 3, 4 and 5

The front perspective view in FIG. 1, rear perspective view in *fig.*2 and the perspective view with an exploded calendar stack in FIG. 3, is representative of our center hold perpetual day reminder calendar. In these figures the display stand is shown with center mounted left and right locating guides 40L and 40R. The perspective view of FIG. 4 is representative of our perpetual day reminder calendar with a bottom holding display stand and the perspective view of FIG. 5 is representative of our perpetual day reminder calendar with a top holding display stand. All display stand parts, center holding display stand [40A, 40B, 40C, 40L, 40R], bottom holding display stand [50A, 50B, 50C] and top holding display stand [60A, 60B, 60C, 60D, 60L, 60R] may be crafted individually or molded in a single unit.

The calendar stack as illustrated consists of five plates over two cubes over five plates. Four of the plates are day indicating plates and the remaining six plates are month indicating plates. The day indicating plates and month indicating plates are the same shape and thickness permitting one of the six month indicating plates to be stored with the four day indicating plates; therefore allowing the five plates over two cubes over five plates configuration of the calendar stack. This balances out the calendar stack and gives our perpetual day reminder calendar a pleasing overall shape. Because the plates are stacked in front of each other and encase the cubes only the necessary calendar information needed is shown.

The center hold perpetual day reminder calendar stack has modified plates to account for the room needed for the left and right locating guides 40L and 40R. The four day indicating plates, [10, 12, 14, 16] or modified plates, [10M, 12M, 14M, 16M] yield eight available sides for the seven days of the week plus one blank. The six month indicating plates, [18, 20, 22, 24, 26, 28] or modified plates, [18M, 20M, 22M, 24M, 26M, 28M] yield twelve available sides for the months of the year. The month indicating plates have an inverted orientation to the day indicating plates.

The calendar stack also contains two date indicating cubes, 30 and 32. Each cube face has one single numeral differing from the numerals on the other faces. One cube is furnished with the numerals 0, 1, 2, 3, 4 and 5, the other cube is furnished with the numerals 0, 1, 2, 6, 7 and 8. The numeral 6 is shaped to serve also as the numeral 9. Through these number combinations every date in question can be easily arranged. As illustrated the thickness of the day indicating plates and month indicating plates are ⅕th the depth of the date indicating cubes; therefore, when they are placed in the calendar stack they present a flat surface displaying the day, date and month of the year. The interlocking fit of the calendar display stand and the calendar stack provide a sturdy and easy to operate calendar.

OPERATION—FIGS. 1, 2, 3, 4 and 5

It does not matter which calendar display stand style is selected, every calendar stack operates identically. Five month indicating plates are placed in the display stand with the current month showing. Next the two date indicating cubes are placed on the five month indicating plates arranged in such a way as to display the current date. Lastly the remaining five plates of the calendar stack consisting of the one leftover month indicating plate and four day indicating plates are placed on top of the stack with the current day of the week showing. By manipulating the order of the plates and cubes it is possible to display any day, date and month of the year. It is also possible to manufacture the calendar stack with month indicating plates on top and day indicating plates on the bottom.

DESCRIPTION—FIGS. 6, 7 and 8

The front perspective views of FIGS. 6, 7 and 8 are representations of our diamond style perpetual day reminder calendars. In these figures the calendar stack is shown with rotated date indicating cubes. The diamond style calendar stacks differ from previous calendar stacks by the different orientation of the date indicating cubes. This mandates the updating of the day indicating plates and month indicating plates to accommodate the new orientation of the date indicating cubes.

The diamond style calendar stack, as illustrated, consists of the same five plates over two cubes over five plates configurations of previous calendar stacks. Four of the plates are day indicating plates and the remaining six plates are month indicating plates. The day indicating plates and month indicating plates are the same shape and thickness permitting one of the six month indicating plates to be stored with the four day indicating plates. This allows the five plates over two cubes over five plates configuration of the diamond calendar stack. This balances out the diamond calendar stack and gives our perpetual day reminder calendar a pleasing overall shape. Because the plates are stacked in front of each other and encase the cubes only the necessary calendar information needed is shown.

The center hold perpetual day reminder with a diamond calendar stack has modified plates to account for the room needed for the left and right locating guides 80L and 80R. The four day indicating plates, [1A, 12A, 14A, 16A] or modified plates, [10AM, 12AM, 14AM, 16AM] yield eight available sides for the seven days of the week plus one blank. The six month indicating plates, [18A, 20A, 22A, 24A, 26A, 28A] or modified plates, [18AM, 20AM, 22AM, 24AM, 26AM, 28AM] yield twelve available sides for the months of the year. The month indicating plates have an inverted orientation to the day indicating plates.

The diamond calendar stack also contains two diagonally orientated date indicating cubes, 30A and 32A. Each cube face has one single numeral differing from the numerals on the other faces. One cube is furnished with the numerals 0, 1, 2, 3, 4 and 5, the other cube is furnished with the numerals 0, 1, 2, 6, 7 and 8. The numeral 6 is shaped to serve also as the numeral 9. Through these number combinations every date in question can be easily arranged. As illustrated the thickness of the day indicating plates and month indicating plates are ⅕th the depth of the date indicating cubes therefore when they are placed in the diamond calendar stack they present a flat surface displaying the day, date and month of the year. The interlocking fit of the diamond style calendar display stand: bottom holding display stand [70A, 70B, 70C], center holding display stand [80A, 80B, 80C], top holding display stand [90A, 90B, 90C, 90D, 90L, 90R] and their diamond calendar stack provide a sturdy and easy to operate calendar.

OPERATION—FIGS. 6, 7 and 8

It does not matter which diamond calendar display stand style is selected, every diamond calendar stack operates identically. Five month indicating plates are placed in the display stand with the current month showing. Next the two date indicating cubes are placed on the five month indicating plates arranged in such a way as to display the current date. Lastly the remaining five plates of the diamond calendar stack consisting of the one leftover month indicating plate and four day indicating plates are placed on top of the stack with the current day of the week showing. By manipulating the order of the plates and cubes it is possible to display any day, date and month of the year. It is also possible to manufacture the diamond calendar stack with month indicating plates on top and day indicating plates on the bottom.

The operational advantage of this open calendar style provides easy access to the calendar's functional pieces. This access makes manipulation of the calendar fast, easy, simple and fun.

Another operational advantage these calendars have, do to their large plate to cube ratios, is the ability to display the day and month using full language. This language clarity allows translations to be made into many languages. Further; these perpetual day reminders, not only work for Gregorian and Julian but also for Jewish and Muslim style calendars by simply substituting the correct terms and translations.

CONCLUSION, RAMIFICATIONS, AND SCOPE

Accordingly, the reader will see that these perpetual day reminder calendars together with their display stands and calendar stacks, demonstrate a new and substantially improved calendar construction. Not only are these calendars fun to operate; they are easy to use and easier to read and understand. They provide much improved access to the calendars functional components.

The strong combination of display stand and integrated calendar stack or integrated diamond calendar stack, has the additional advantages:

a) it allows the stand to present the calendar;

b) it provides the user with a familiar and recognizable calendar configuration;

c) it offers a secure rattle free fit between components;

d) it gives the calendar a balanced look and effortless operation.

Although the description above contains many specificities, these should not be construed as limiting the scope of the invention but as merely providing illustrations of some of the presently preferred embodiments of this invention. Many other ramifications and variations are possible within the teachings of the invention. It is possible to manufacture the day indicating plates ¼th the depth of the date indicating cubes and the month indicating plates ⅙th the depth of the date indicating cubes. This would allow the month indicating plates to be stacked together; even though this would preclude a random stacking of the plates. Do to the ability to use full language for the days and months the calendar can be easily translated into a variety of languages and used by many cultures. By design not only are Gregorian/Julian calendars possible but also Jewish and Muslim embodiments. The calendars are also ideal to promote, advertise or identify a cause.

Thus the scope of the invention should be determined by the appended claims and their legal equivalents, and not by the examples given.

We claim:

1. A perpetual day reminder calendar for illustrating day, date and month information, including:

a) a set of day indicating plates with day indica;

b) a set of month indicating plates with month indica;

c) a set of date indicating cubes with date indica;

d) a display stand with locating guides in one of three possible configurations, top holding, center holding or bottom holding;

the improvement wherein said day indicating plates and said month indicating plates identically shaped to fit around said date indicating cubes in a manner providing an interlocking of, said plates and cubes and the shielding of unneeded indica allowing only the needed day, date and month indica to be viewed and the interlocking pieces forming a calendar stack having a unique locating interaction feature with said display stand whereby the perpetual day reminder calendar can be easily manipulated for the sequential displaying of day, date and month indica.

2. The calendar recited in claim 1 wherein the position of the cubes face to face, or edge to edge enabling the identical shaping of the day indicating plates and month indicating plates allowing for the positioning of plates top or bottom in the calendar stack.

* * * * *